US006176678B1

(12) United States Patent
Brainch et al.

(10) Patent No.: US 6,176,678 B1
(45) Date of Patent: Jan. 23, 2001

(54) APPARATUS AND METHODS FOR TURBINE BLADE COOLING

(75) Inventors: Gulcharan S. Brainch, West Chester; Michael J. Danowski, Cincinnati, both of OH (US)

(73) Assignee: General Electric Company, Cincinnati, OH (US)

( * ) Notice: Under 35 U.S.C. 154(b), the term of this patent shall be extended for 0 days.

(21) Appl. No.: 09/186,677

(22) Filed: Nov. 6, 1998

(51) Int. Cl.[7] ..... F01D 5/18
(52) U.S. Cl. ..... 416/97 R; 416/96 R
(58) Field of Search ..... 416/97 R, 97 A, 416/95, 96 R, 96 A; 415/115

(56) References Cited

U.S. PATENT DOCUMENTS

| | | | | |
|---|---|---|---|---|
| 4,726,104 | * | 2/1988 | Foster et al. | 29/156.8 B |
| 5,261,789 | * | 11/1993 | Butts et al. | 416/96 R |
| 5,340,278 | | 8/1994 | Magowan | 416/96 R |
| 5,344,283 | | 9/1994 | Magowan et al. | 415/115 |
| 5,368,441 | * | 11/1994 | Sylvestro et al. | 416/97 R |
| 5,382,135 | | 1/1995 | Green | 416/97 R |
| 5,397,217 | * | 3/1995 | DeMarche et al. | 416/97 R |
| 5,498,133 | * | 3/1996 | Lee | 415/115 |
| 5,591,007 | * | 1/1997 | Lee et al. | 416/97 R |
| 5,813,835 | * | 9/1998 | Corsmeier et al. | 416/97 R |
| 5,820,336 | * | 10/1998 | Hashimoto | 415/115 |
| 5,954,475 | * | 9/1999 | Matsuura et al. | 415/115 |

* cited by examiner

*Primary Examiner*—Edward K. Look
*Assistant Examiner*—Ninh Nguyen
(74) *Attorney, Agent, or Firm*—Andrew C. Hess; Rodney M. Young

(57) ABSTRACT

A turbine blade includes a platform and an airfoil having a plurality of trailing edge slots separated by land areas larger than the slots. The slots have an exit diffusion half angle of about two degrees. Cooling air flows through the slots and over a trailing edge of the airfoil. The platform includes a plurality of openings extending through the platform at an angle. The openings are positioned between a suction side of the blade and a second end of the platform. The openings transport disk post cooling air to a surface of the platform and provide cooling for the platform.

19 Claims, 4 Drawing Sheets

APPARATUS AND METHODS FOR TURBINE BLADE COOLING

BACKGROUND OF THE INVENTION

This invention relates generally to turbine engines and, more particularly, to methods and apparatus for cooling turbine engine blades and blade platforms.

High pressure turbine blades include an airfoil that is prone to trailing edge root cracks. Propagation of these cracks leads to eventual liberation of the airfoil. The cracks can potentially progress to a complete corn-cobbed rotor. The cracks are caused, at least in part, by blade components experiencing gas temperatures beyond the material capabilities.

To satisfy blade life requirements, the airfoils typically are cooled during operation. Airfoil cooling typically is achieved by convection cooling, e.g., in serpentine passages and film openings, and by film cooling which provides a protective layer of relatively cool air over an external surface of the airfoil. Cooling requirements are typically set by high temperature component life requirements for creep rupture and oxidation at the turbine blade operating conditions.

Cracking may be aggravated by skewed dovetails and sharp pressure side bleed slot geometric configurations for the blades. These configurations may cause very early trailing edge root crack indications in factory test engines.

For example, in the art of turbine blade cooling, it is well known to align the openings in the airfoil and the platform with airfoil regions experiencing high flow path gas temperatures. Generally, thermal gradients within a given radial span, i.e., low thermal gradient between blade bulk and its edges, are reduced. Additionally, cooling levels are matched with the mechanical stresses experienced in the rotating environment.

Accordingly, it would be desirable to provide a cooling configuration that improves cooling near the root trailing edge. It would be further desirable to reduce thermal stresses in a given radial span, in particular at the trailing edge region. It would be still further desirable if the reduced thermal stresses in the trailing edge vicinity prolonged low cycle fatigue life of the blades.

BRIEF SUMMARY OF THE INVENTION

These and other objects may be attained by a turbine blade for a turbine engine that includes a plurality of trailing edge slots separated by land areas larger than the slots. More particularly, the turbine blade includes an airfoil having a suction side, a pressure side, a base, and a trailing edge connecting the suction side and the pressure side. The blade further includes a platform having a first end, a second end, a first side, and a second side. The airfoil is connected to the platform at the base of the airfoil by a fillet. The blade also includes a blade shank that is connected to the platform.

Trailing edge slots in the pressure side of the airfoil extend approximately to the trailing edge. The land areas extend a length about equal to the slot length. The slots are diffuser slots that have an exit diffusion half angle from about zero degree to about four degrees. A plurality of openings are also formed in the airfoil and are in communication with a first end of the slots. Cooling air flows out of the openings, through the slots, and over the trailing edge of the airfoil. A second end of the slots is positioned at the trailing edge of the airfoil.

The land areas include a first portion adjacent the first end of the slots and a second portion adjacent the second end of the slots. The first portion of the land area is larger than the first end of the slots and the second portion of the land area is larger than the second end of the slots.

The platform includes a plurality of openings that extend through the platform at an angle relative to a surface of the platform. The openings are positioned between the blade suction side and the platform second end and are configured to transport disk post cooling air to a surface of the platform and provide convection cooling and film cooling for the platform.

The turbine blade with the diffuser slots having a small diffusion half angle improves the match in thermal displacements from the chordwise thermal gradient along the blade trailing edge. The net stresses are thus reduced in the bottom trailing edge vicinity for a prolonged low cycle fatigue life. In addition, the platform openings further reduce the thermal stresses at the bottom trailing edge region.

DETAILED DESCRIPTION OF THE INVENTION

Figure 1:
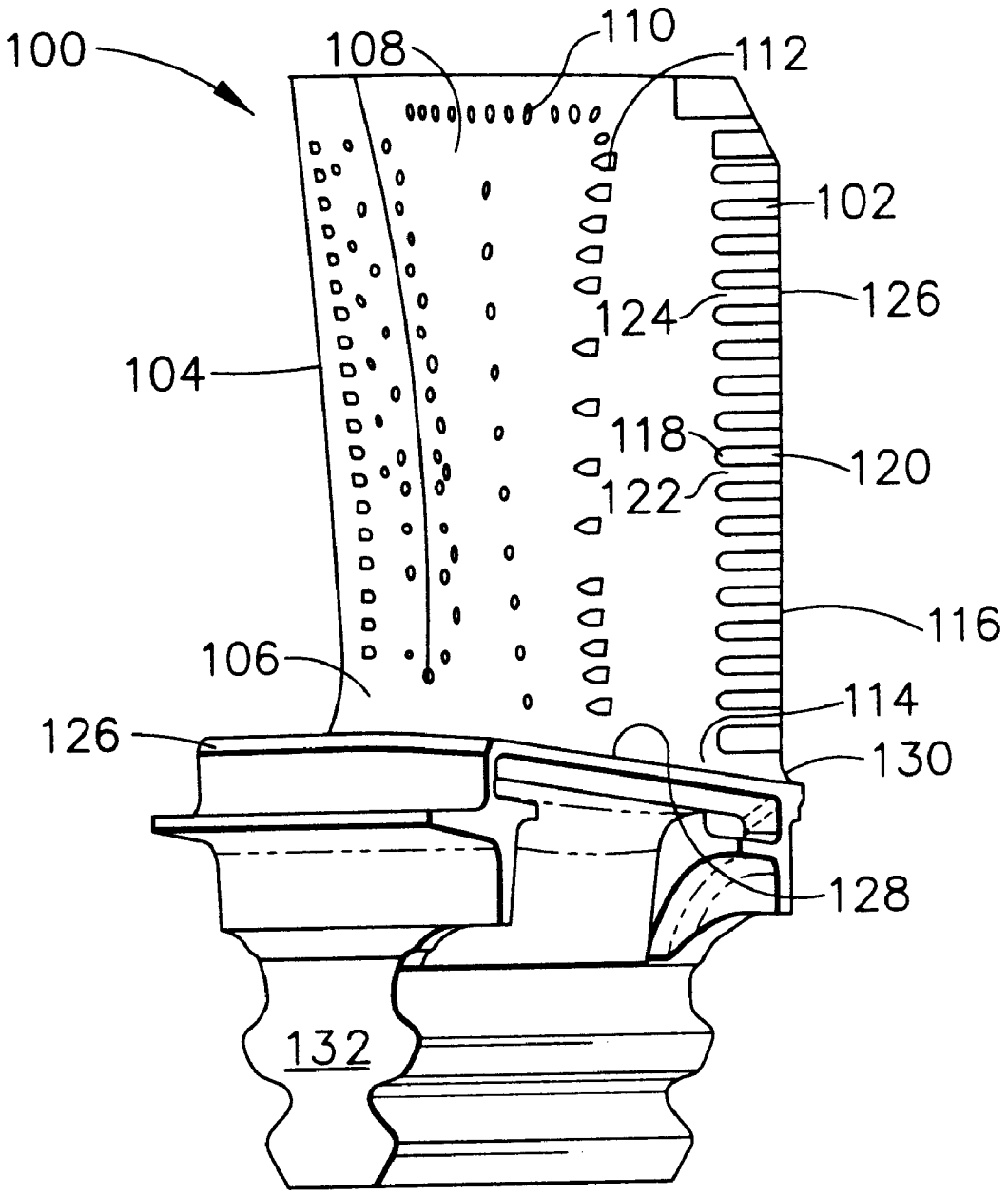
FIG. 1 is a schematic view of a turbine blade including a plurality of trailing edge diffusion slots.

FIG. 1 is a schematic illustration of a turbine blade 100 including a plurality of trailing edge diffusion slots 102 that have a half angle of diffusion less than about four degrees. Turbine blade 100 includes an airfoil 104 including a pressure side 106 and a suction side (not shown). Pressure side includes a wall 108, a first plurality of film openings, i.e., tip film openings, 110, a second plurality of film openings 112, and trailing edge diffusion slots 102. Airfoil 104 further includes a base 114 and a trailing edge 116. Trailing edge 116 connects pressure side wall 108 and a wall of the suction side, as explained below in greater detail.

Diffusion slots 102 include a first end 118 and a second end 120. An opening (not shown) extends through wall 108 and is in communication with first end 118 of slots 102. Slots 102 extend from first end 118 towards trailing edge 116. In one embodiment, slots 102 extend to trailing edge 116 and second end 120 is adjacent trailing edge 116. Slots 102 are separated from each other by a plurality of land areas 122 that extend the length of diffusion slots 102. Land areas 122 include a first portion 124 adjacent first end 118 and a second portion 126 adjacent second end 120.

Turbine blade 100 further includes a platform 128, a fillet 130, and a blade shank 132. Platform 128 is connected to airfoil 104 at base 114, and fillet 130 is connected to both airfoil base 114 and platform 128. Blade shank 132 is connected to platform 128 on an opposite side from airfoil 104. Blade shank 132 is configured to position turbine blade 100 in a rotor disc (not shown) in the turbine engine.

Figure 2:
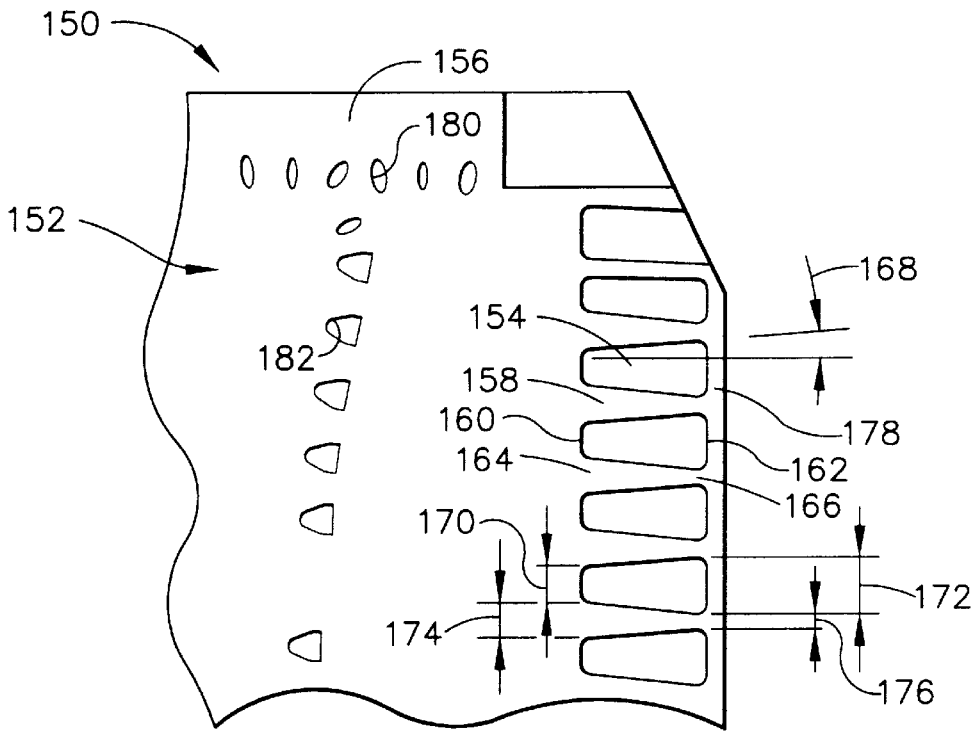
FIG. 2 (PRIOR ART)
FIG. 2 is a schematic view of a known configuration of trailing edge diffusion slots.

FIG. 2 is a schematic view of a turbine blade airfoil 150 including a pressure side 152 having a known configuration of trailing edge diffusion slots 154. Pressure side 152 includes a side wall 156 having diffusion slots 154 formed therein. Diffusion slots 154 are separated from adjacent slots 154 by land areas 158. Slots 154 have a first end 160 and a second end 162. Land areas 158 have a first portion 164 adjacent first end 160 and a second portion 166 adjacent second end 162.

Typical diffusion slots 154 have a half angle of diffusion 168 from about five to about 10 degrees and land areas 158 are smaller than slots 154. For example, slots 154 have a radial height 170 at first end 160 that is about 0.05 inches and a radial height 172 at second end 162 that is about 0.084 inches. Typically, land areas 158 have a radial height 174 at first portion 164 that is about 0.05 inches and a radial height 176 at second portion 166 that is about 0.016 inches. This configuration aggravates thermal strain at a trailing edge 178 of airfoil 150 due to a mismatch in thermal growth between airfoil 150 and the platform (not shown in FIG. 2).

Airfoil 150 also includes a first plurality of film openings, i.e., tip film openings, 180 and a second plurality of film openings 182 that provide cooling to pressure side wall 156. Openings 180 and 182 extend through wall 156 and are in communication with an aft cavity (not shown) that extends through at least a portion of airfoil 150. Cooling air is supplied through openings 180 and 182 and provides protection for airfoil 150 from hot combustion gases that contact airfoil 150.

Figure 3:
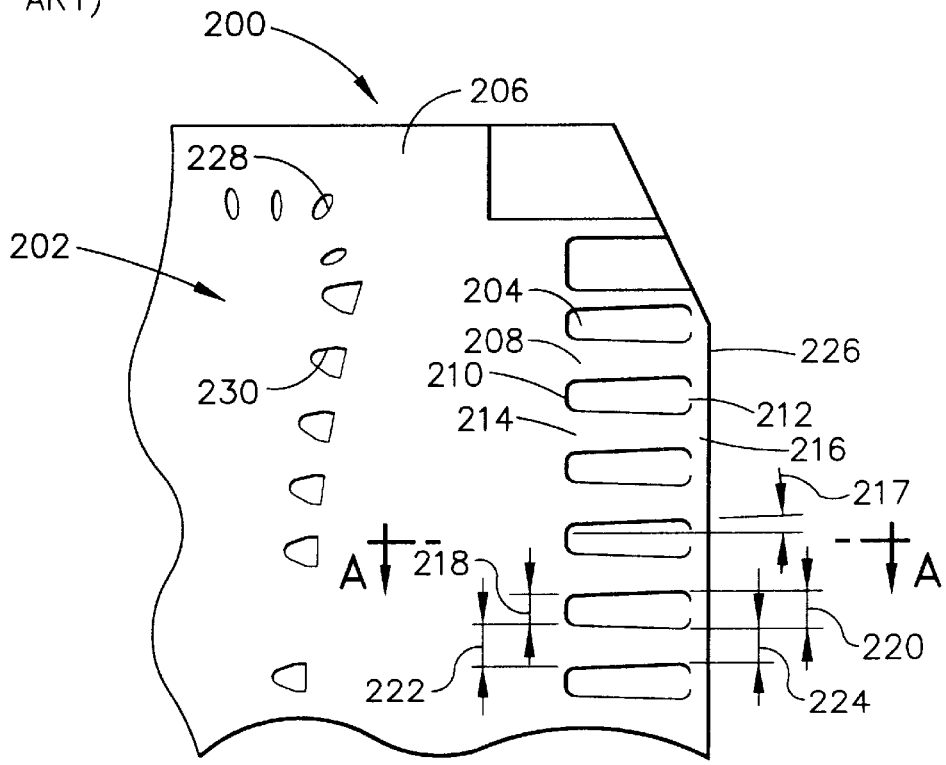
FIG. 3 is a schematic view of an alternative embodiment of a turine blade assembly including trailing edge diffusion slots.

FIG. 3 is a schematic view of a turbine blade airfoil 200 including a pressure side 202 having a configuration of trailing edge diffusion slots 204 according to one embodiment of the invention. Pressure side 202 includes a side wall 206 and diffusion slots 204 are formed in side wall 206. Diffusion slots 204 are separated from adjacent slots 204 by land areas 208. Slots 204 have a first end 210 and a second end 212. Land areas 208 have a first portion 214 adjacent first end 210 and a second portion 216 adjacent second end 212. Slots 204 have a diffusion half angle 217 from about one degree to about four degrees. More particularly, diffusion half angle 217 from about one degree to about three degrees. In an exemplary embodiment, diffusion half angle 217 of about two degrees and slots 204 are smaller than land areas 208. Specifically, slots 204 have a radial height 218 at first end 210 that is about 0.04 inches and a radial height 220 at second end 212 that is about 0.046 inches. Land areas 208 have a radial height 222 at first portion 214 that is about 0.06 inches and a radial height 224 at second portion 216 that is about 0.054 inches. Slots 204 and land areas 208 are configured to increase the chordwise thermal gradient to better match the thermal growth at trailing edge 226 with a blade platform (not shown in FIG. 3) and thus reduce thermal stresses induced at trailing edge 226. In one embodiment, trailing edge 226 is angled near a tip of airfoil 200.

Airfoil 200 also includes a first plurality of film openings. i.e., tip film openings, 228 and a second plurality of film openings 230 that provide cooling to pressure side wall 206. Openings 228 and 230 extend through wall 206 and are in communication with an aft cavity (not shown in FIG. 3) that extends through at least a portion of airfoil 200. Cooling air is supplied through openings 228 and 230 and provides protection for airfoil 200 from hot combustion gases that contact airfoil 200.

Second end 212 of slots 204 is located at trailing edge 226 in order to provide sufficient cooling to trailing edge 226. Tip film openings 228 are separated from trailing edge 226 by a preselected distance that, in one embodiment, is greater than the distance separating film openings 230 from trailing edge 226. This spacing promotes a proper temperature gradient from tip film openings 228 to trailing edge 226. The configuration of slots 204 and land areas 208 improve the match in thermal displacements resulting from a radial thermal gradient in a blade shank (not shown in FIG. 3) and a platform (not shown in FIG. 3) and a chordwise thermal gradient between the aft cavity in airfoil 200 and trailing edge 226. This configuration reduces the net stresses in the trailing edge vicinity for a prolonged low cycle fatigue life.

Figure 4:
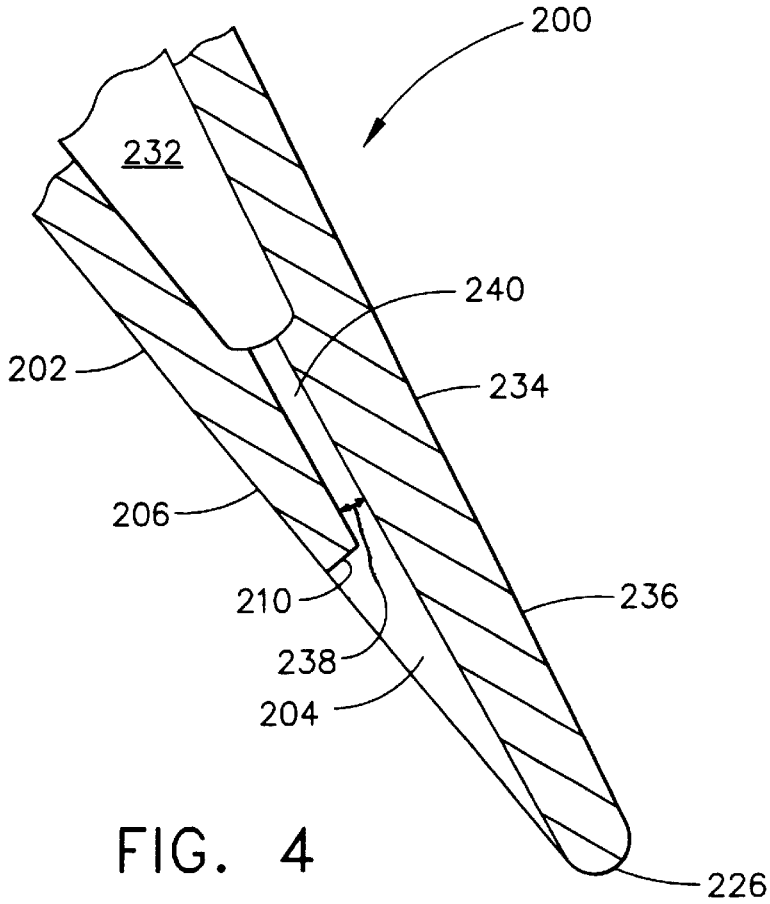
FIG. 4 is a schematic view of a partial cross section of the turbine blade shown in FIG. 3 along line AA.

FIG. 4 is a cross section of turbine airfoil 200 illustrating trailing edge slot 204 in communication with an aft feed cavity 232. Airfoil 200 includes a suction side 234 having a side wall 236. Trailing edge 226 connects pressure side 202 and suction side 234. Trailing edge slot 204 has a width 238 that, in one embodiment, is about 0.012 inches. An opening 240 is in communication with first end 210 of slot 204. Opening 240 extends between pressure side wall 206 and suction side wall 236 and connects slot 204 with cavity 232. Cooling air is supplied to cavity 232 through cooling ducts (not shown). The cooling air then passes through opening 240 and into slots 204.

The configuration of slots 204 and land areas 208 can be used in any area requiring thermal stress or thermal strain management. More specifically, the configuration can be utilized on any cooled blade or vane.

Figure 5:
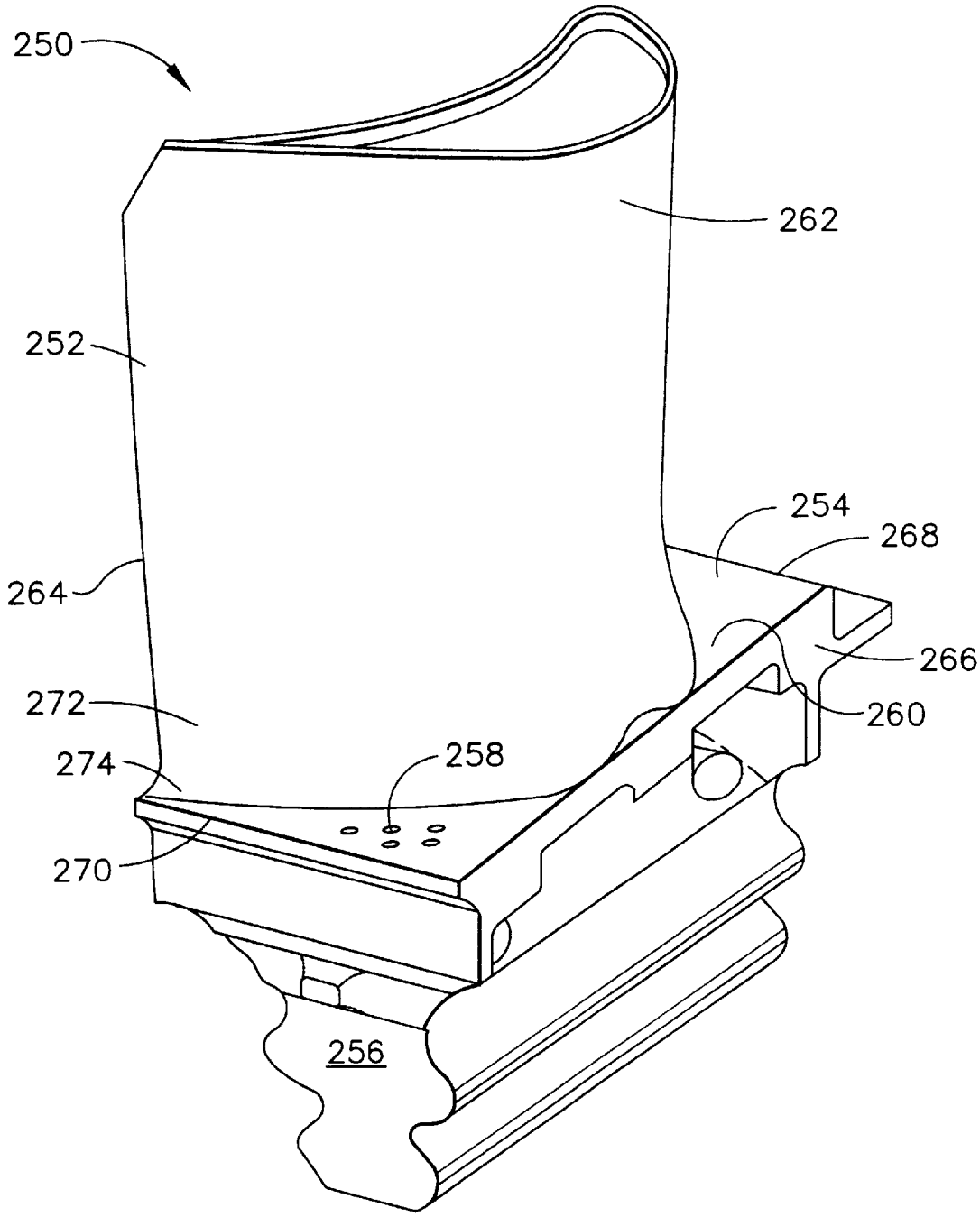
FIG. 5 is a schematic view of another alternative embodiment of a turbine blade including a plurality of platform openings.

FIG. 5 is a schematic illustration of a turbine blade 250 including an airfoil 252, a platform 254, and a blade shank 256. Platform 254 includes a plurality of cooling openings 258 extending through platform 254 to reduce blade shank temperature gradients and to provide cooling to a surface 260 of platform 254.

Cooling openings 258 are configured to thermally match platform curl resulting from a radial thermal gradient to the airfoil root trail edge displacement caused by a chord wise thermal gradient. Cooling openings 258 are positioned in regions of relatively cooler areas of platform 254. Typically, the conventional approach by those skilled in the art is to position cooling openings in the higher temperature regions of the turbine blade. The airflow over platforms including cooling openings in these conventional configurations is highly turbulent and generates many vortices, or secondary flows, around the airfoil fillet regions. These secondary flows typically grow in size as they travel aft and at a point of potential introduction of platform cooling air into the flow path, the strength of the secondary flows is sufficient to promote significant mixing of the cooling flow and the main gas stream. This mixing results in a substantially reduced cooling effectiveness.

The cooling configuration of openings 258 is contrary to the standard configuration since the openings are configured to lower the metal temperature of platform 254 where it is already cooler than desired for oxidation/creep rupture requirements. Cooling openings 258 lower the radial thermal gradient in the blade shank region and reduce the thermal strain experienced by trailing edge 226. In addition, openings 258 provide local cooling of trailing edge 226.

Airfoil 252 includes a suction side 262, a pressure side (not shown) and a trailing edge 264 connecting suction side 262 and the pressure side. Platform 254 includes a first side (not shown), a second side 266, a first end 268, and a second end 270. Airfoil 252 includes a base 272 connected to platform 254. A fillet 274 is connected to airfoil base 272 and to platform 254.

In an exemplary embodiment, airfoil 252 is positioned on platform 254 such that trailing edge 264 is adjacent the first side of platform 254. Cooling openings 258 are located between suction side 262 and platform second edge 270. In addition, cooling openings 258 are closer to platform second side 266 than to the platform first side. In one embodiment. there are five cooling openings having a size of about 0.015 inches. More specifically, openings 258 are circular with a diameter of about 0.015 inches.

Figure 6:
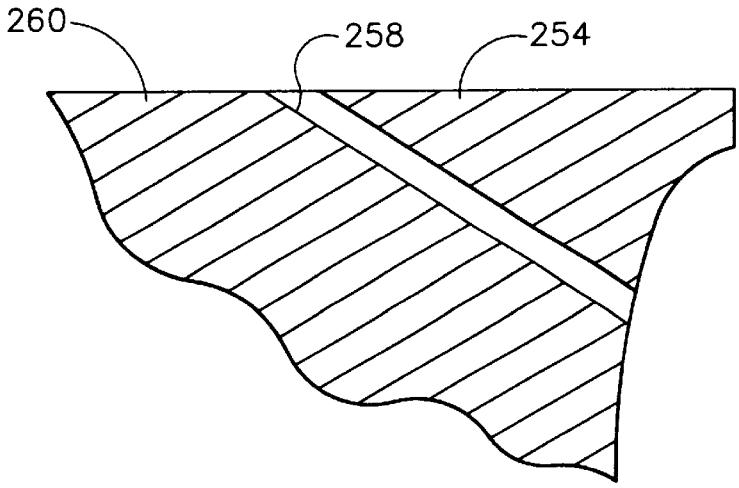
FIG. 6 is a schematic view of a partial cross section of the platform shown in FIG. 5.

FIG. 6 is a schematic view of a partial cross section of platform 254 illustrating one cooling opening 258 extending through platform 254. Opening 258 extends through platform 254 at an angle that, in one embodiment, is less than about 45 degrees. The angle of opening 258 is selected to allow cool air flowing through opening 258 to provide both convection cooling inside opening 258 and film cooling over platform 254. The angle is kept below about 45 degrees to provide formation and retention of a protective layer of cooler air on, and adjacent to, blade platform surface 260 which forms a portion of a flow path through the turbine engine. In addition, the small angle allows opening 258 to be longer which improves the internal convection cooling and reduces the radial thermal gradient in the vicinity of the openings.

The cooling air is provided from a disk post cavity (not shown) and is supplied through opening 258 to platform surface 260. Alternatively, the cooling air can be provided through shank cooling openings (not shown) connected to a blade serpentine circuit (not shown) or a dovetail slot (not shown) by bypassing forward and aft retainer seal wires (not shown). The number and spacing of openings 258 in platform 254 are such that a single continuous sheet of cool air is supplied to at least a portion of platform surface 260.

Of course, the number and size of the cooling openings can be altered to accommodate different flow path and cooling requirements. Additionally, the cooling air can be supplied from alternate sources, such as the blade supply system since it is relatively cool air and has the potential for additional cooling, if desired.

A method for reducing thermal strain in a turbine blade for a turbine engine includes forming an airfoil having a plurality of slots on a pressure side of the airfoil, extending the slots to a trailing edge of the airfoil, and providing a plurality of land areas between the slots. In one embodiment, the land areas are larger than the slots. The slots are formed as diffuser slots having an exit diffusion half angle from about one degree to about four degrees. More specifically, the slots are formed to have an exit diffusion half angle of about two degrees.

A plurality of openings are formed through the airfoil and are in communication with a first end of the slots. A second end of the slots is formed at a trailing edge of the airfoil. The land areas are provided with a first portion adjacent the first end of the slots, and a second portion adjacent the second end of the slots. In an exemplary embodiment, the first end of the slots is formed to have a radial height of about 0.04 inches and the second end is formed to have a radial height of about 0.046 inches. In addition, the first portion of the land area is formed to have a radial height of about 0.06 inches and the second portion of the land area is formed to have a radial height of about 0.054 inches.

The blade is further formed to include a platform connected to the airfoil. A plurality of openings are formed in the platform and extend through the platform at an angle less than about 45 degrees. The airfoil is positioned on the platform such that the openings are positioned between a suction side of the airfoil and a second end of the platform. Further, the trailing edge is adjacent a first side of the platform and the openings are formed closer to a second side of the platform than to the first side of the platform. In an exemplary embodiment, five openings, each having a diameter of about 0.015 inches are formed in the platform. The openings are configured to transport disk post cooling air to a surface of the platform and to provide convection cooling and film cooling for the platform.

The turbine blade with the diffuser slots having a small diffusion half angle increases the chordwise thermal gradient and provides a better match between the thermal growth of the airfoil trailing edge and the blade platform.

The net stresses are thus reduced in the bottom trailing edge vicinity for a prolonged low cycle fatigue life. In addition, the platform openings address blade root trail edge distress by managing thermal and mechanical stresses to improve blade life.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An airfoil for a turbine engine, said airfoil comprising:

a first wall;

a second wall;

a trailing edge connecting said first wall and said second wall, a plurality of slots in said first wall extending to said trailing edge, said slots having an exit diffusion half angle from greater than zero degrees to about four degrees, said slots having a first end and a second end, said slot first end having a height less than a height of said slot second end; and a plurality of land areas separating said slots, a height of said slots at said trailing edge smaller than a height of said land areas at said trailing edge.

2. An airfoil in accordance with claim 1 wherein said slots are diffuser slots.

3. An airfoil in accordance with claim 1 wherein said exit diffusion half angle is about two degrees.

4. An airfoil in accordance with claim 1 further comprising a plurality of openings, wherein said slots have a first end in communication with said openings, and a second end positioned at said trailing edge, said first end having a radial height of about 0.04 inches and said second end having a radial height of about 0.046 inches.

5. An airfoil in accordance with claim 1 wherein said land areas have a first portion adjacent said first end of said slots and a second portion adjacent said second end of said slots, said first portion having a radial height of about 0.06 inches and said second portion having a radial height of about 0.054 inches.

6. An airfoil in accordance with claim 1 wherein said slots have a width of about 0.012 inches at said first end.

7. A turbine blade for a turbine engine, said blade comprising:

an airfoil including a pressure side, a suction side, a trailing edge connecting said pressure side and said suction side, and a base; and a platform including a first end, a second end, a first side, a second side, and a plurality of openings extending through said platform, said platform connected to said airfoil base, said openings positioned between said airfoil suction side and said platform second end, wherein said trailing edge is adjacent said first side and all of said openings are closer to said second side than to said first side.

8. A blade assembly in accordance with claim 7 wherein said plurality of openings comprises five openings.

9. A blade assembly in accordance with claim 7 wherein said openings have a diameter of about 0.015 inches.

10. A blade assembly in accordance with claim 7 wherein said platform has a surface, said openings configured to provide disk post cooling air to said platform surface.

11. A blade assembly in accordance with claim 10 wherein said openings are configured to provide a continuous sheet of cool air to at least a portion of said platform surface.

12. A blade assembly in accordance with claim 7 wherein said openings are configured to provide convection cooling and film cooling for said platform.

13. A blade assembly in accordance with claim 7 wherein said openings extend through said platform at an angle less than about 45 degrees.

14. A method for reducing thermal strain in a turbine blade for a turbine engine, the blade including an airfoil having a suction side, a pressure side, a trailing edge connecting the suction side and the pressure side, a platform including a first end, a second end, a first side, a second side, and a fillet, the platform connected to the airfoil, and the fillet connected to the airfoil and the platform, said method comprising the steps of:

forming a plurality of slots on the pressure side of the airfoil wherein the slots have a first end having a first height and a second end having a second height greater than the slot first height such that the slots have an exit diffusion half angle from greater than zero degrees to about four degrees, extending the slots to the trailing edge; and providing a plurality of land areas between the slots, wherein the heights of the land areas at the trailing edge are larger than the heights of the slots at the trailing edge.

15. A method in accordance with claim 14 wherein said step of forming a plurality of slots comprises the step of forming diffuser slots having an exit diffusion half angle of about two degrees.

16. A method in accordance with claim 14 wherein the blade further includes a plurality of openings, said step of forming a plurality of slots includes the steps of:

forming a first end in communication with the openings; and forming a second end at the trailing edge, wherein the first end has a radial height of about 0.04 inches and the second end has a radial height of about 0.046 inches.

17. A method in accordance with claim 14 wherein said step of providing a plurality of land areas includes the step of:

providing a land area first portion adjacent the first end of the slots; and providing a land area second portion adjacent the second end of the slots, wherein the first portion has a radial height of about 0.06 inches and the second portion has a radial height of about 0.054 inches.

18. A method in accordance with claim 14 further comprising the steps of:

forming a plurality of openings in the platform;

extending the openings through the platform at an angle less than about 45 degrees, wherein the openings are positioned between the airfoil suction side and the platform second end, and the trailing edge is adjacent the first side and the openings are closer to the second side than to the first side.

19. A method in accordance with claim 14 wherein said step of forming a plurality of openings comprises the steps of:

forming five openings having a diameter of about 0.015 inches; and configuring the openings to transport disk post cooling air to a surface of the platform and provide convection cooling and film cooling for the platform.

* * * * *